US011344894B2

(12) United States Patent
Wey et al.

(10) Patent No.: US 11,344,894 B2
(45) Date of Patent: May 31, 2022

(54) TRAMP METAL SEPARATION ASSEMBLY

(71) Applicant: TAI HAN EQUIPMENT ENTERPRISE CO., LTD., Taipei (TW)

(72) Inventors: Shyh-Yi Wey, Taipei (TW); Wen-Cheng Chang, Taipei (TW); Ken-Der Lin, Taipei (TW); Bao-Ding Li, Taipei (TW)

(73) Assignee: TAI HAN EQUIPMENT ENTERPRISE CO., LTD., Taipei (TW)

( * ) Notice: Subject to any disclaimer, the term of this patent is extended or adjusted under 35 U.S.C. 154(b) by 0 days.

(21) Appl. No.: 17/146,208

(22) Filed: Jan. 11, 2021

(65) Prior Publication Data

US 2021/0316315 A1 Oct. 14, 2021

(30) Foreign Application Priority Data

Apr. 8, 2020 (TW) ..... 109111850

(51) Int. Cl.
*B03C 1/12* (2006.01)

(52) U.S. Cl.
CPC ..... *B03C 1/12* (2013.01); *B03C 2201/20* (2013.01)

(58) Field of Classification Search
CPC .. B03C 1/12; B03C 1/284; B03C 1/26; B03C 2201/20; B03C 1/10
USPC ..... 209/217
See application file for complete search history.

(56) References Cited

U.S. PATENT DOCUMENTS 4,867,869 A * 9/1989 Barrett ..... B03C 1/284 312/334.44
5,066,390 A * 11/1991 Rhodes ..... B03C 1/284 209/217
5,188,239 A * 2/1993 Stowe ..... B03C 1/284 209/229
5,351,603 A * 10/1994 Yuda ..... F15B 15/1428 92/128
6,250,475 B1 * 6/2001 Kwasniewicz ..... B03C 1/284 209/229

(Continued)

FOREIGN PATENT DOCUMENTS

CN 204602393 U * 9/2015

*Primary Examiner* — Gene O Crawford
*Assistant Examiner* — Muhammad Awais
(74) *Attorney, Agent, or Firm* — Birch, Stewart, Kolasch & Birch, LLP

(57) ABSTRACT

A tramp metal separation assembly comprises a housing, a core rod and a sleeve tube. The housing includes a first and second discharging areas and a feeding area. The core rod includes a first and second non-magnetic sections and a magnetic section. The core rod is mounted on the housing in a way that the first and second non-magnetic sections correspond respectively to the first and second discharging areas and the magnetic section corresponds to the feeding area. The sleeve tube includes a first and second portions. The sleeve tube is sleeved outside the core rod in a way that it is moveable between a first position, wherein the first portion corresponds to the magnetic section and the second portion corresponds to the second non-magnetic section, and a second position, wherein the first portion corresponds to the first non-magnetic section and the second portion corresponds to the magnetic section.

9 Claims, 6 Drawing Sheets

(56) References Cited

U.S. PATENT DOCUMENTS

| | | | | |
|---|---|---|---|---|
| 8,132,674 | B1 * | 3/2012 | Allore | B03C 1/0332 209/229 |
| 10,300,497 | B2 * | 5/2019 | Kwasniewicz | B03C 1/284 |

* cited by examiner

TRAMP METAL SEPARATION ASSEMBLY

BACKGROUND OF THE INVENTION

1. Field of the Invention

The present invention relates to equipment for removing tramp metals from a stream of raw materials, and more particularly to a tramp metal separation assembly for automatically and continuously removing tramp metals from a stream of raw materials.

2. Description of the Related Art

A prior art grate magnet apparatus is disclosed in U.S. Pat. No. 4,867,869. This grate magnet apparatus utilizes non-magnetic tubes slidably housing elongated magnets to replace the magnets of the prior art. When in use, the magnets are manually removed from the tubes to let the tramp metals fall off the exterior of the tubes. While the prior art grate magnet apparatus is easy in tramp metal separation, it suffers from some drawbacks. First, the magnets must be pulled out of the tubes by hand, so the efficiency is too low. Further, to ensure that no tramp metals remain in the raw materials, the raw material flow must be interrupted during the separating process. In other words, the prior art grate magnet apparatus cannot be operated continuously to remove tramp metals from raw materials.

Another prior art grate magnet apparatus is disclosed in U.S. Pat. No. 8,132,674. While this grate magnet apparatus can be operated continuously, it needs a wiper assembly to remove tramp metals from the magnets. So, when operating for a period of time, the magnets will lose its magnetism due to the high operating temperature thereof.

It is preferable, therefore, to configure a tramp metal separation assembly which ensures that the tramp metal separating process can be operated efficiently, automatically and continuously. It is also important that during the tramp metal separating process, the operating temperature can be maintained at an acceptable value. The present invention addresses all of these problems.

SUMMARY OF THE INVENTION

Thus, a tramp metal separation assembly for efficiently, automatically and continuously removing tramp metals from a stream of raw materials is disclosed herein. The tramp metal separation assembly comprises a housing, at least a cylindrical core rod and at least a sleeve tube. The housing includes a first discharging area, a second discharging area and a feeding area between the first discharging area and the second discharging area. The cylindrical core rod is made of non-magnetic materials and includes a first longitudinal axis, an axial extending hollow interior having a first part, a second part and a third part, the second part adapted to be a magnetic section by being filled therewith a set of magnets, the first part and the third part respectively adapted to be a first non-magnetic section and a second non-magnetic section. The cylindrical core rod is mounted on the housing in a way that the first and second non-magnetic sections correspond respectively to the first and second discharging areas and the magnetic section corresponds to the feeding area. The sleeve tube is made of non-magnetic materials and includes a first portion, a second portion, a longitudinal length shorter than the longitudinal length of the cylindrical core rod and an axial hole with an inner diameter larger than the outer diameter of the cylindrical core rod. The sleeve tube is sleeved outside the cylindrical core rod in a way that it is moveable to and fro along the first longitudinal axis of the cylindrical core rod and between a first position, wherein the first portion corresponds to the magnetic section to capture tramp metals of the raw materials and the second portion corresponds to the second non-magnetic section to discharge tramp metals of the raw materials, and a second position, wherein the first portion corresponds to the first non-magnetic section to discharge tramp metals of the raw materials, and the second portion corresponds to the magnetic section to capture tramp metals of the raw materials.

In a preferred embodiment, the housing includes a front wall, a rear wall, a first side wall, a second side wall, a first inner plate and a second inner plate. The front and rear walls combine with the first and second side walls to define a generally elongate receiving space within the housing. The first inner plate and the second inner plate are respectively disposed between the first side wall and the second side wall to divide the space into the first discharging area, the second discharging area and the feeding area. The cylindrical core rod is adapted to pass through the first inner plate and the second inner plate and secures respectively each of ends thereof on the front and rear walls. The sleeve tube is also adapted to pass through the first inner plate and the second inner plate in a way that it is moveable to and fro between the first and second positions.

In another preferred embodiment, the tramp metal separation assembly may be configured to comprise a plurality of the cylindrical core rods and a plurality of the sleeve tubes. Each of the cylindrical core rods is combined with each of the sleeve tubes respectively as the way mentioned above. The cylindrical core rods and the sleeve tubes are divided into a plurality of groups. Each of the groups is arranged in a way that each of the cylindrical core rods and the sleeve tubes thereof is parallel to each other in a horizontal plane and each of the horizontal planes on where a group is located is spaced apart such that the cylindrical core rods and sleeve tubes are provided in a staggered configuration to ensure contact of the raw materials with the first and second portions of the sleeve tubes.

In a further preferred embodiment, the tramp metal separation assembly may comprise a first driving plate connected to the first end of each of the sleeve tubes and disposed in the first discharging area and a second driving plate connected to the second end of each of the sleeve tubes and disposed in the second discharging area. Each of the driving plates is configured to be moveable along the cylindrical core rods. The tramp metal separation assembly may also comprise at least a linear actuator. The linear actuator is connected with the driving plates for actuating the sleeve tubes to move back and forth between the first position and the second position. The linear actuator may be a pneumatic linear actuator that is controlled by a solenoid-operated pneumatic valve assembly, as is well known in the art. The tramp metal separation assembly may also include a control mean to control motion of the linear actuator to automatically move the sleeve tubes between the first and second positions either at predetermined time intervals or in response to a user command that is provided to the control means.

BRIEF DESCRIPTION OF THE DRAWINGS

The above, as well as other advantages of the present invention will become readily apparent to those skilled in the art from the following detailed description when considered in the light of the accompanying drawings in which.

DETAILED DESCRIPTION OF THE INVENTION

Figure 1:
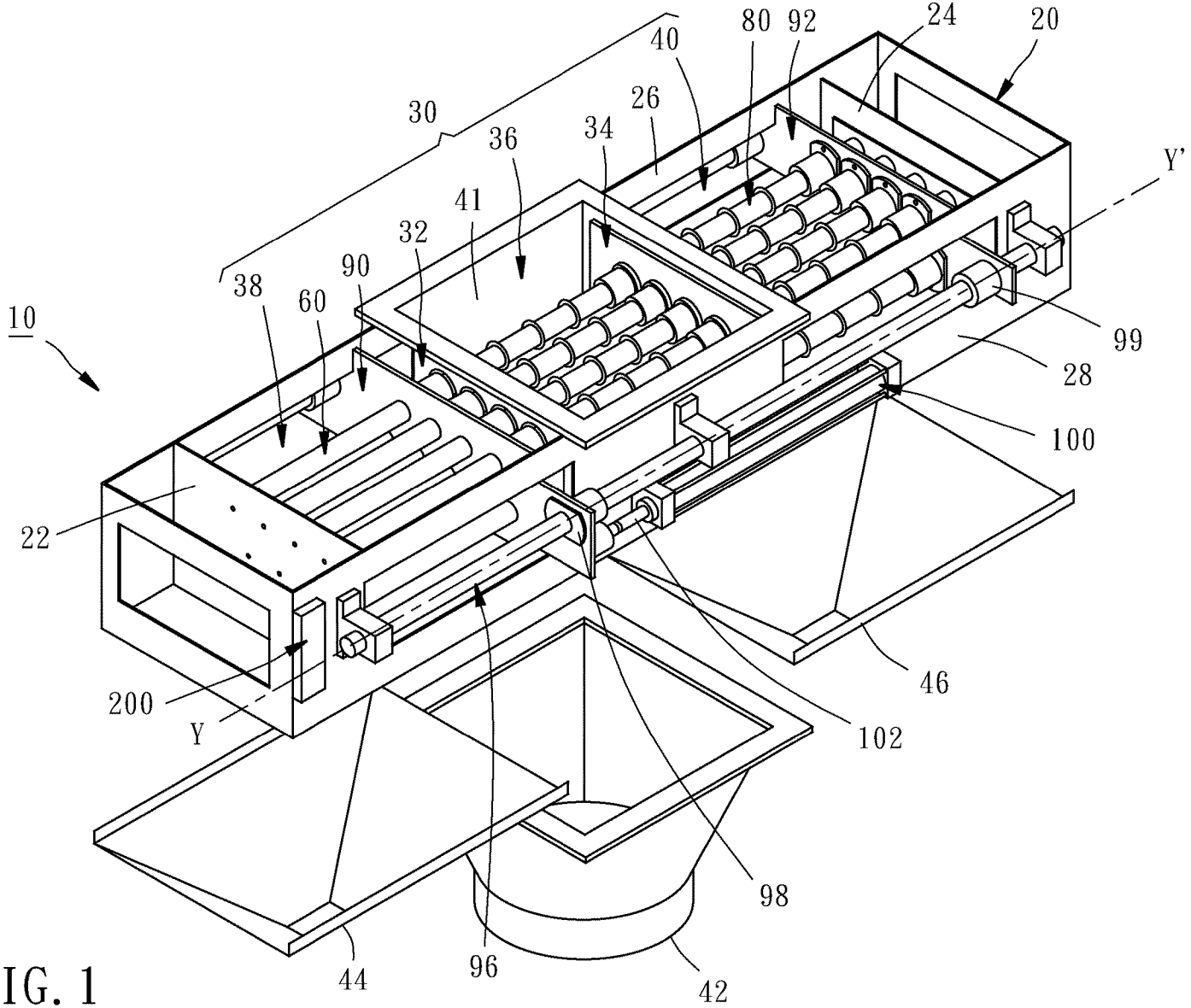
FIG. 1 is a perspective view of a tramp metal separation assembly according to a preferred embodiment of the present invention.

Referring now to FIG. 1, it shows a tramp metal separation assembly 10 configured according to a preferred embodiment of the present invention. The tramp metal separation assembly 10 generally includes a housing 20, a plurality of cylindrical core rods 60, a plurality of sleeve tubes 80, and a pair of linear actuators 100.

The housing 20 comprises a front wall 22, a rear wall 24, a first side wall 26 and a second side wall 28. The front and rear walls 22, 24 combine with the first and second side walls 26, 28 to define a generally elongate receiving space 30 within the housing 20. The housing 20 further comprises a first inner plate 32 and a second inner plate 34. The first inner plate 32 and the second inner plate 34 are respectively disposed between the first side wall 26 and the second side wall 28 to divide the space 30 into a first discharging area 38, a second discharging area 40 and a feeding area 36 between the first discharging area 38 and the second discharging area 40. The feeding area 36 has an inlet 41 into which a raw material containing tramp metals are introduced and an outlet 42 from which the raw material is discharged. The first and second discharging areas 38, 40 respectively have a first discharging outlet 44 and a second discharging outlet 46 disposed in the bottom side thereof.

Figure 2:
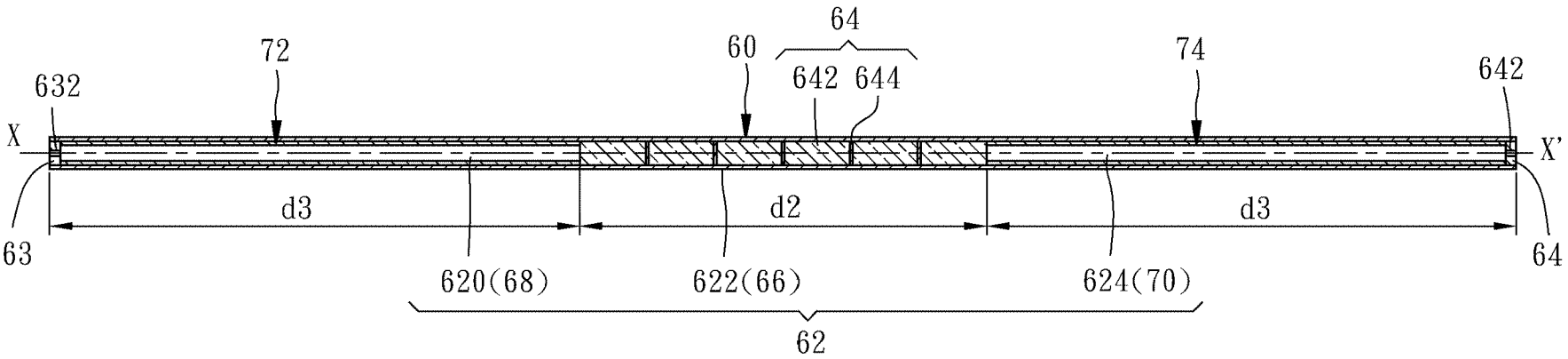
FIG. 2 is a longitudinal sectional view of a core rod of the embodiment shown in FIG. 1.

The cylindrical core rod 60, as shown in FIG. 2, is made of non-magnetic materials, such as stainless steel, titanium alloy, copper alloy or aluminum alloy, etc. The cylindrical core rod 60 includes a first longitudinal axis X-X', an axial extending hollow interior 62 with a first closed end 63 and a second closed end 64. The hollow interior 62 sequentially divides into a first part 620, a second part 622 and a third part 624. In this embodiment, each part has approximately the same length. The second part 622 forms a magnetic section 66 by being filled therewith a set of magnets 64 and the first part 620 and the third part 624 respectively form a first non-magnetic section 68 and a second non-magnetic section 70. The set of magnets 64, in this embodiment, includes five magnetic members 642 made of NdFeB magnets, and four spacers 644 made of high magnetic permeability or high saturation magnetization materials such as pure iron, low carbon steel or iron-cobalt alloy. Each of the spacers 644 is respectively disposed between the two adjacent magnetic members 642. The tramp metal separation assembly 10 further comprises a first non-magnetic inner tube 72 and a second non-magnetic inner tube 74 wherein the first non-magnetic inner tube 72 is disposed within the first part 620 of the hollow interior 62 and abuts against a first side of the set of magnets 64, and the second non-magnetic inner tube 74 is disposed within the third part 624 of the hollow interior 62 and abuts against a second side of the set of magnets 64. The first and second non-magnetic inner tubes 72, 74 are not only used to reinforce the strength of the cylindrical core rod 60, but also used to abut on both sides of the set of magnets 64 so that the set of magnets 64 can be firmly arranged in the second part 622 of the hollow interior 62.

Figure 3:
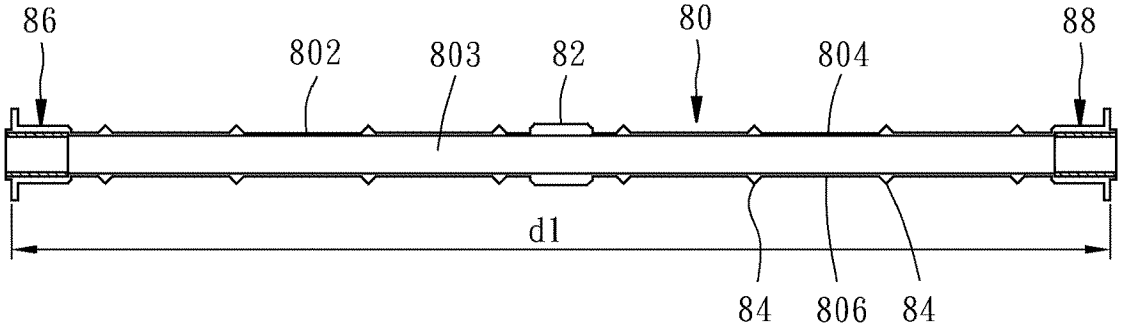
FIG. 3 is a longitudinal sectional view of a sleeve tube of the embodiment shown in FIG. 1.
Figure 4:
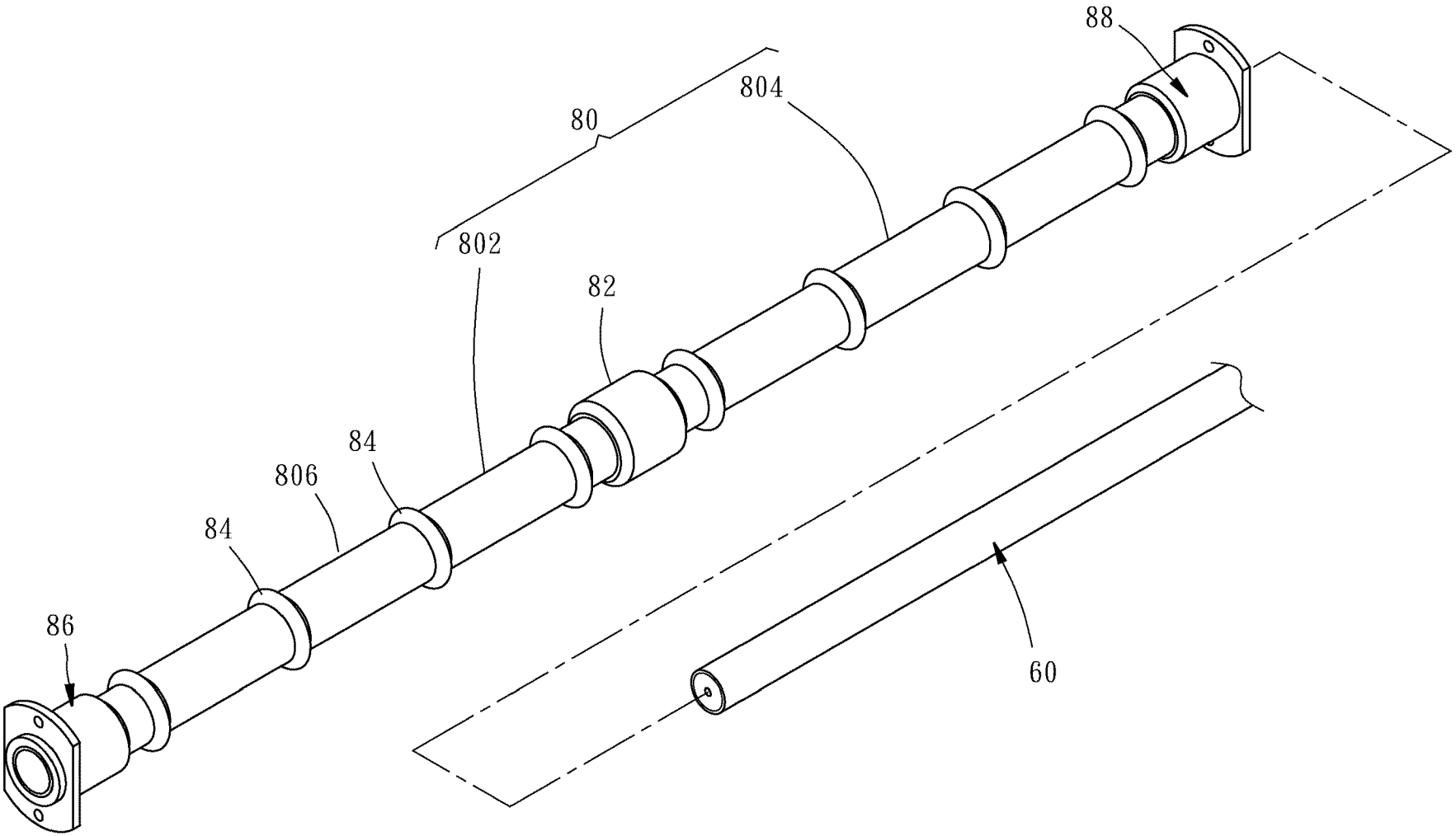
FIG. 4 is an exploded view of the core rod and the sleeve tube, showing that the sleeve tube sleeves through outside the core rod.

The sleeve tube 80, as shown in FIGS. 3 and 4, is also made of non-magnetic materials and includes a first portion 802, a second portion 804, a longitudinal length d1 and an axial hole 803 with an inner diameter larger than the outer diameter of the cylindrical core rod 60. The first portion 802 has the same length as the second portion 804. The longitudinal length d1 of the sleeve tube 80 is approximately equal to the sum of the length d2 of the magnetic section 66 and the length d3 of the first non-magnetic region 68 or the second non-magnetic region 70.

Referring now to FIGS. 4-8, the first inner plate 32 of the housing 10 has a plurality of first bores 320 and the second inner plate 34 of the housing 10 has a plurality of second bores 340. The first bores 320 and the second bores 340 are coaxial and have the same diameter. In combination, the cylindrical core rod 60 passes through the first bores 320 and the second bores 340 and secures each of the closed ends 63, 64 thereof on each of the end walls 22, 24 of the housing 10 in a way that the first non-magnetic section 68 and the second non-magnetic section 70 correspond respectively to the first and second discharging area 38, 40, and the magnetic section 66 corresponds to the feeding area 36. In this embodiment, each of the closed ends 63, 64 is respectively provided with a screw hole 632, 642 for securing the core rod 60 on each of the end walls 22, 24 by bolts (not shown in the drawings).

Figure 6:
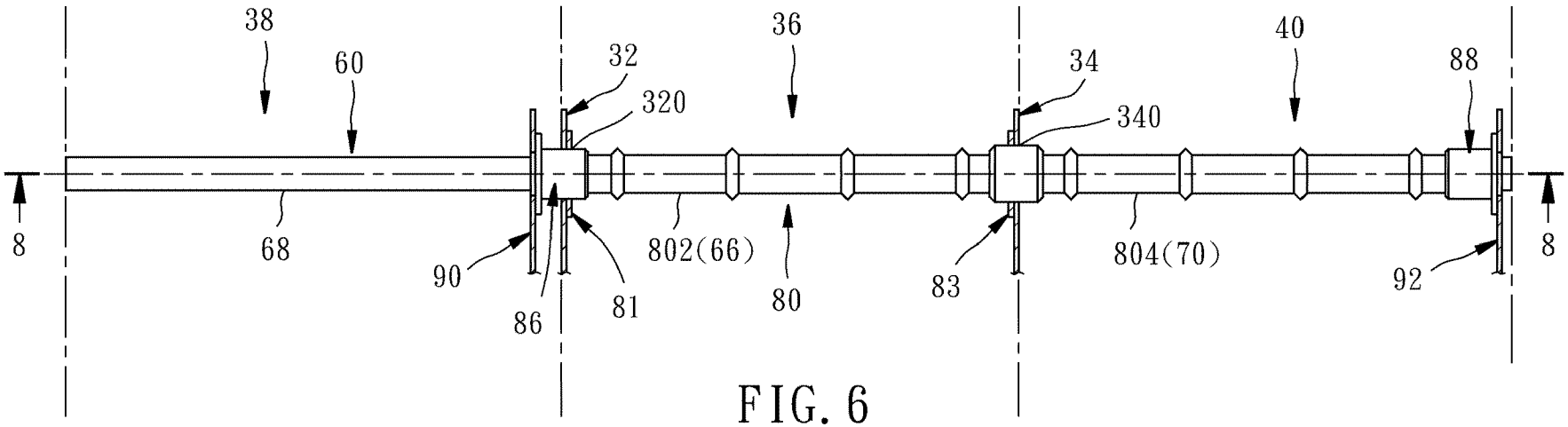
FIG. 6 is a cross-sectional view taken along the direction 6-6 of FIG. 5, in which the sleeve tube is in a first position.
Figure 7:
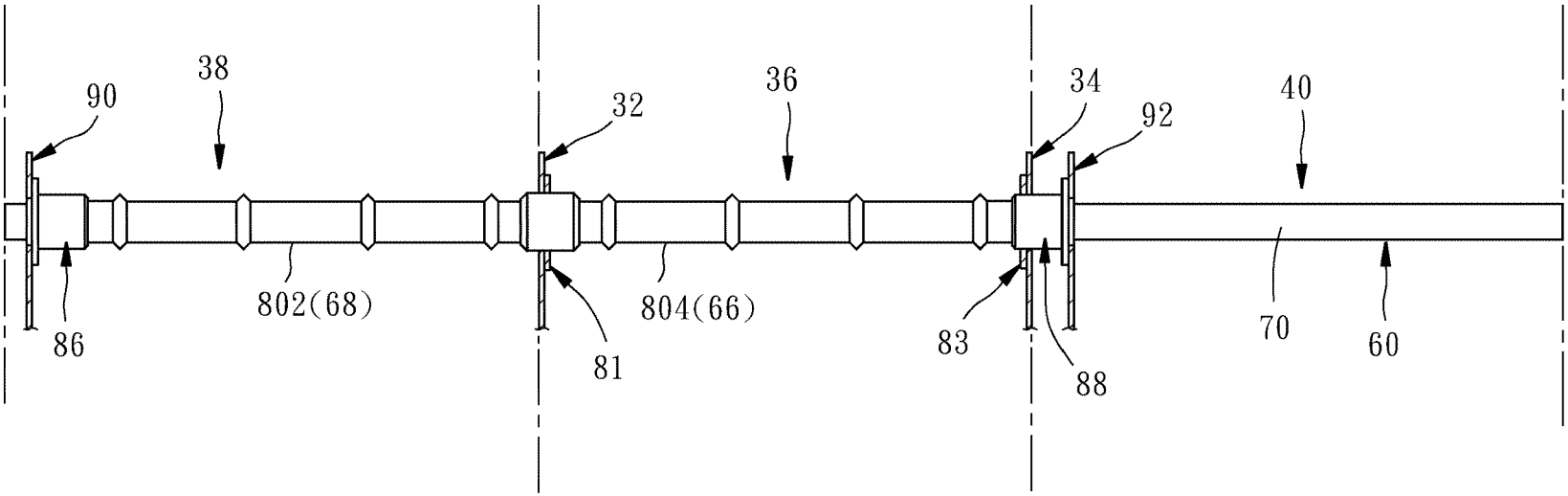
FIG. 7 is a cross-sectional view taken along the direction 6-6 of FIG. 5, in which the sleeve tube is in a second position.
Figure 8:
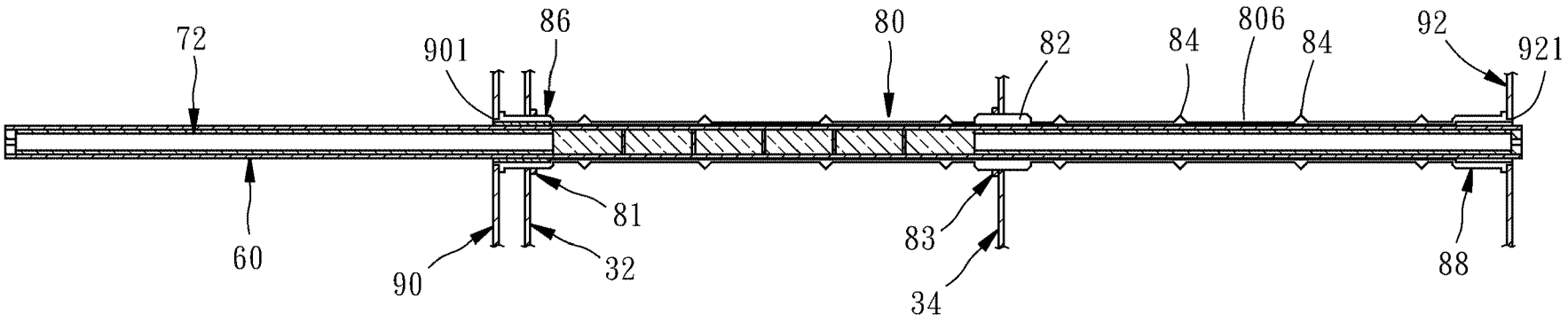
FIG. 8 is a cross-sectional view taken along the direction 8-8 of FIG. 6.

The sleeve tube 80 is sleeved outside the cylindrical core rod 60 by the axial hole 803 thereof and also extends through the first bore 320 and the second bore 340 in a way that it is moveable along the first longitudinal axis X-X' of the cylindrical core rod 60 and between a first position, as shown in FIG. 6, wherein the first portion 802 corresponds to the magnetic section 66 and the second portion 804 corresponds to the second non-magnetic section 70, and a second position, as shown in FIG. 7, wherein the first portion 802 corresponds to the first non-magnetic section 68 and the second portion 804 corresponds to the magnetic section 66. In this embodiment, as shown in FIG. 6 or 7, the periphery of the first bore 320 and the second bore 340 respectively are disposed a first bushing 81, 83 thereon so that the sleeve tubes 80 can move smoothly between the first position and the second position.

In addition, in this embodiment, as shown in FIG. 3, the sleeve tube 80 includes a convex ring 82 disposed between the first portion 802 and the second portion 804 and a plurality of flanges 84 for dividing the surface of the sleeve tube 80 into a plurality of receiving regions 806. The width and the outer diameter of each of the flanges 84 are smaller than that of the convex ring 82 so that when the first portion 802 or the second portion 804 of the sleeve tube 80 corresponds to the magnetic section 66 of the cylindrical core rod 60, each of the receiving regions 806 can evenly capture tramp metals, and during reciprocating movement, the tramp metals captured thereon will not be scraped off by the inner plates 32, 34. Furthermore, each end of the sleeve tube 80 is respectively sleeved with a second bushing 86, 88 for maintaining the cylindrical core rod 60 located at the center of the axial hole 803 and reducing the friction between the sleeve tube 80 and the cylindrical core rod 60.

Figure 5:
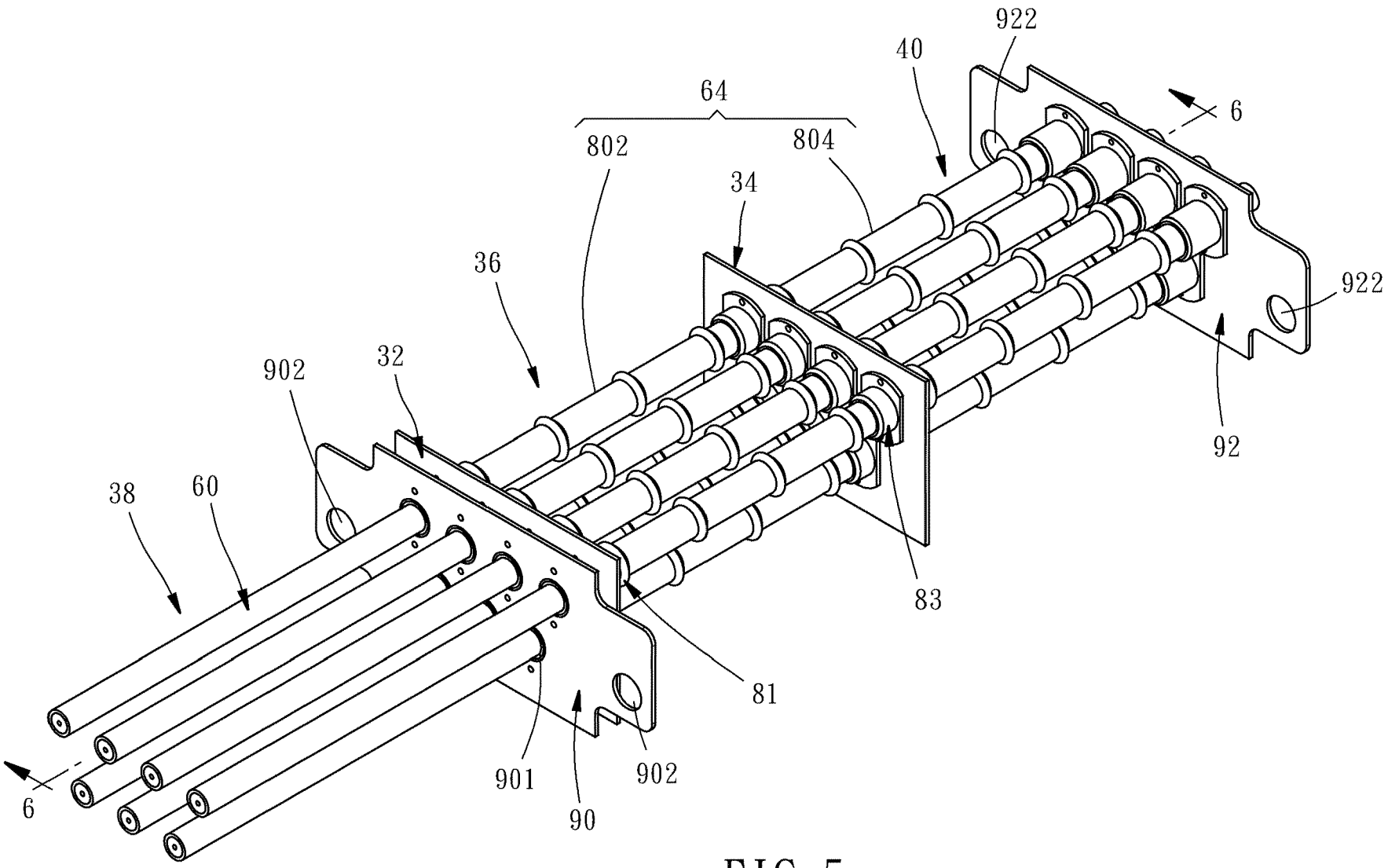
FIG. 5 is a perspective view in partial portion of the embodiment shown in FIG. 1.

In this embodiment, as shown in FIGS. 1 and 5, the tramp metal separation assembly 10 includes seven core rods 60, which are divided into a first group and a second group. The first group has four core rods 60 being secured between the end walls 22, 24 in a way that the four core rods 60 are parallel to each other and in a first horizontal plane. The second group has three core rods 60 being secured between the end walls 22, 24 in a way that the three core rods 60 are parallel to each other and in a second plane horizontal spaced apart the first horizontal plane. All of the cylindrical core rods 66 are provided in a staggered configuration to ensure contact of the raw materials with the magnetic section 66 of each of the cylindrical core rods 60. The tramp metal separation assembly 10 also includes seven sleeve tubes 80, each of which is combined with each of the cylindrical core rods 60 respectively as the way mentioned above. When each of the sleeve tubes 80 is located at the first position, as shown in FIG. 6, the first portion 802 corresponds to the feeding area 36 such that each of the receiving regions 806 will capture the tramp metals of the raw materials, and the second portion 804 corresponds to the second discharging area 40 such that the tramp metals captured on each of the receiving regions 806 will automatically leave therefrom and fall to the second discharging outlet 46. When each of the sleeve tubes 80 is located at the second position, as shown in FIG. 7, the second portion 804 corresponds to the feeding area 36 such that each of the receiving regions 806 thereof will capture the tramp metals of the raw materials, and the first portion 802 corresponds to the first discharging area 38 such that the tramp metals captured on each of the receiving regions 806 will automatically leave therefrom and fall to the first discharging outlet 44. Thereby, when the sleeve tubes 80 reciprocally move between the first and second positions, the tramp metal separation assembly 10 can automatically and continuously remove the tramp metals from the raw materials.

In operation, as shown in FIGS. 1 and 5, the tramp metal separation assembly 10 may further comprise a first driving plate 90 fixedly connected to the first end of each of the sleeve tubes 80 and disposed in the first discharging area 38, wherein the first driving plate 90 has a plurality of third bores 901 for being passed through by the cylindrical core rods 60, and a second driving plate 92 fixedly connected to the second end of each of the sleeve tubes 80 and disposed in the second discharging area 40, wherein the second driving plate 92 has a plurality of forth bores 921 for being passed through by the cylindrical core rods 60.

The tramp metal separation assembly 10 also comprises a pair of linear actuators 100 respectively disposed on the housing 10 and connected with one of the driving plates 90, 92 or both for actuating the sleeve tubes 80 to move back and forth between the first position and the second position. In this embodiment, each of the linear actuators 100 may be a pneumatic linear actuator that is controlled by a solenoid-operated pneumatic valve assembly, as is well known in the art. Each of the pneumatic linear actuators 100 has a piston 102 coupled to one of the driving plates 90, 92 so that all of the sleeve tubes 80 can be actuated at the same time to move reciprocally between the first and second positions.

In this embodiment, the tramp metal separation assembly 10 further comprises a pair of guiding rods 96 disposed respectively on each of the side walls 26, 28 of the housing 30. Each of the guiding rods 96 has a second longitudinal axis Y-Y' parallel to the first longitudinal axis X-X' of the cylindrical core rod 60 and passes through a guiding opening 902, 922 disposed on each of the driving plates 90, 92 for guiding the back and forth movement thereof. The periphery of each of the guiding openings 902, 922 is disposed with a third bushing 98, 99 so that each of the driving plates 90, 92 can move smoothly on each of the guiding rods 96.

In addition, in this embodiment, the tramp metal separation assembly 10 further includes a control means 200 secured on the housing 10, which are coupled with each of the linear actuators 100 for controlling the action thereof. In typical operation, the linear actuators 100 are performed automatically, either at predetermined time intervals or in response to a user command that is provided to the control means 200. The control means 200 can usually be a programmable logic controller (PLC) which is well known in the art. Generally speaking, the control means 200 may include control elements such as an input module, a timing module, an execution module, and a solenoid valve etc.

What is claimed is:

1. A tramp metal separation assembly, comprising:

a housing including a first discharging area, a second discharging area and a feeding area between the first discharging area and the second discharging area;

a cylindrical core rod made of non-magnetic materials and including a first longitudinal axis, an axial extending hollow interior having a first part, a second part and a third part, the second part adapted to be a magnetic section by being filled therewith a set of magnets, the first part and the third part respectively adapted to be a first non-magnetic section and a second non-magnetic section, the cylindrical core rod being mounted on the housing in a way that the first and second non-magnetic sections correspond respectively to the first and second discharging areas and the magnetic section corresponds to the feeding area; and a sleeve tube made of non-magnetic materials and including a first portion, a second portion, a longitudinal length shorter than the longitudinal length of the cylindrical core rod and an axial hole with an inner diameter larger than the outer diameter of the cylindrical core rod, the sleeve tube being sleeved outside the core rod in a way that it is moveable to and fro along the first longitudinal axis of the core rod and between a first position, wherein the first portion corresponds to the magnetic section to capture tramp metals of the raw materials and the second portion corresponds to the second non-magnetic section to discharge tramp metals captured thereon, and a second position, wherein the first portion corresponds to the first non-magnetic section to discharge tramp metals captured thereon, and the second portion corresponds to the magnetic section to capture tramp metals of the raw materials, wherein the housing includes a front wall, a rear wall, a first side wall, a second side wall, a first inner plate and a second inner plate, the front and rear walls combine with the first and second side walls to define a generally elongate receiving space within the housing, the first inner plate and the second inner plate are respectively disposed between the first side wall and the second side wall to divide the space into the first discharging area, the second discharging area and the feeding area, the cylindrical core rod is adapted to pass through the first inner plate and the second inner plate and secures respectively each of ends thereof on the front and rear walls, and the sleeve tube is also adapted to pass through the first inner plate and the second inner plate in a way that it is moveable to and fro between the first and second positions, wherein the tramp metal separation assembly further comprises a first driving plate, a second driving plate and a linear actuator, wherein the first driving plate is fixedly connected to a first end of the sleeve tube and disposed in the first discharging area; the second driving plate is fixedly connected to a second end of the sleeve tube and disposed in the second discharging area, each of the driving plates is configured to be moveable along the cylindrical core rod, and the linear actuator is connected with one of the driving plates for actuating the sleeve tube to move back and forth between the first position and the second position, and wherein the first driving plate has a third bore for being passed through by the first non-magnetic section of the cylindrical core rod and the second driving plate has a fourth bore for being passed through by the second non-magnetic section of the cylindrical core rod.

2. The tramp metal separation assembly of claim 1, further comprising a first non-magnetic inner tube and a second non-magnetic inner tube, wherein the first non-magnetic inner tube is disposed within the first part and abuts against a first side of the set of magnets, and the second non-magnetic inner tube is disposed within the third part and abuts against a second side of the set of magnets.

3. The tramp metal separation assembly of claim 1, further comprising a plurality of the cylindrical core rods and a plurality of the sleeve tubes, wherein the cylindrical core rods and the sleeve tubes are divided into a plurality of groups, each of the groups is arranged in a way that each of the cylindrical core rods and the sleeve tubes thereof is parallel to each other in a horizontal plane, and each of the horizontal planes is spaced apart such that the cylindrical core rods and the sleeve tubes are provided in a staggered configuration to ensure contact of the raw materials with the first and second portions of the sleeve tubes.

4. The tramp metal separation assembly of claim 1, wherein the first inner plate has at least a first bore and the second inner plate has at least a second bore, the first and second bores are coaxial and have the same diameter, the cylindrical core rod passes through the first and second bores to secure respectively each of ends thereof on the front and rear walls of the housing.

5. The tramp metal separation assembly of claim 4, wherein the sleeve tube includes a convex ring disposed between the first portion and the second portion and has a first outer diameter smaller than the diameter of the first and second bores.

6. The tramp metal separation assembly of claim 5, wherein the sleeve tube includes a plurality of flanges for dividing the surface of the sleeve member into a plurality of receiving regions, and each of the flanges has a second outer diameter smaller than the first outer diameter of the convex ring.

7. The tramp metal separation assembly of claim 1, further comprising a control means coupled with the linear actuator to control the action thereof.

8. A tramp metal separation assembly, comprising:

a housing including a first discharging area, a second discharging area and a feeding area between the first discharging area and the second discharging area;

a cylindrical core rod made of non-magnetic materials and including a first longitudinal axis, an axial extending hollow interior having a first part, a second part and a third part, the second part adapted to be a magnetic section by being filled therewith a set of magnets, the first part and the third part respectively adapted to be a first non-magnetic section and a second non-magnetic section, the cylindrical core rod being mounted on the housing in a way that the first and second non-magnetic sections correspond respectively to the first and second discharging areas and the magnetic section corresponds to the feeding area; and a sleeve tube made of non-magnetic materials and including a first portion, a second portion, a longitudinal length shorter than the longitudinal length of the cylindrical core rod and an axial hole with an inner diameter larger than the outer diameter of the cylindrical core rod, the sleeve tube being sleeved outside the core rod in a way that it is moveable to and fro along the first longitudinal axis of the core rod and between a first position, wherein the first portion corresponds to the magnetic section to capture tramp metals of the raw materials and the second portion corresponds to the second non-magnetic section to discharge tramp metals captured thereon, and a second position, wherein the first portion corresponds to the first non-magnetic section to discharge tramp metals captured thereon, and the second portion corresponds to the magnetic section to capture tramp metals of the raw materials, wherein the housing includes a front wall, a rear wall, a first side wall, a second side wall, a first inner plate and a second inner plate, the front and rear walls combine with the first and second side walls to define a generally elongate receiving space within the housing, the first inner plate and the second inner plate are respectively disposed between the first side wall and the second side wall to divide the space into the first discharging area, the second discharging area and the feeding area, the cylindrical core rod is adapted to pass through the first inner plate and the second inner plate and secures respectively each of ends thereof on the front and rear walls, and the sleeve tube is also adapted to pass through the first inner plate and the second inner plate in a way that it is moveable to and fro between the first and second positions, wherein the tramp metal separation assembly further comprises a first driving plate, a second driving plate and a linear actuator, wherein the first driving plate is fixedly connected to a first end of the sleeve tube and disposed in the first discharging area; the second driving plate is fixedly connected to a second end of the sleeve tube and disposed in the second discharging area, each of the driving plates is configured to be moveable along the cylindrical core rod, and the linear actuator is connected with one of the driving plates for actuating the sleeve tube to move back and forth between the first position and the second position, and wherein the tramp metal separation assembly further comprises a guiding rod disposed on one of the side walls of the housing, wherein the guiding rod has a second longitudinal axis parallel to the first longitudinal axis of the cylindrical core rod and is coupled with the driving plates for guiding the back and forth movement thereof.

9. The tramp metal separation assembly of claim 1, wherein the linear actuator is a pneumatic linear actuator.

* * * * *